United States Patent [19]

Danti

[11] 4,403,463

[45] Sep. 13, 1983

[54] PACKAGING IN EXTENSIBLE BANDS

[76] Inventor: Bernard R. Danti, Six Alfred Cir., Bedford, Mass. 01730

[21] Appl. No.: 149,346

[22] Filed: May 13, 1980

Related U.S. Application Data

[63] Continuation-in-part of Ser. No. 88,609, Oct. 26, 1979, Pat. No. 4,304,332.

[51] Int. Cl.[3] ..... B65B 21/24

[52] U.S. Cl. ..... 53/398; 53/399; 53/441; 53/585; 53/291; 53/48

[58] Field of Search ..... 53/398, 399, 441, 556, 53/585, 291, 292, 294, 48

[56] References Cited

U.S. PATENT DOCUMENTS

| | | | |
|---|---|---|---|
| 2,864,212 | 12/1958 | Bruce | 53/585 X |
| 3,264,796 | 8/1966 | Tomozak | 53/585 |
| 3,386,371 | 6/1968 | Farmer | 53/585 |
| 3,710,539 | 1/1973 | Cothran | 53/441 |
| 3,774,367 | 11/1973 | Lerner | 53/556 |
| 3,837,478 | 9/1974 | Cunningham | 53/556 |
| 3,892,057 | 7/1975 | Goode | 53/412 X |
| 3,974,628 | 8/1976 | Konstantin | 53/585 X |
| 3,999,357 | 12/1976 | Marantz | 53/449 X |
| 4,069,643 | 1/1978 | Young | 53/556 |
| 4,269,314 | 5/1981 | Barrash | 53/441 |

FOREIGN PATENT DOCUMENTS

| | | | |
|---|---|---|---|
| 1561780 | 3/1980 | United Kingdom | 53/556 |

*Primary Examiner*—John Sipos
*Attorney, Agent, or Firm*—Andrew F. Kehoe

[57] ABSTRACT

A novel process for packaging goods within stretch-type plastic films. The process comprises the steps of preforming the package elements so that on-line sealing and long cooling cycles are not necessary during rapid packaging procedures when the film is extended under high stress. The required extension is achieved by the use of film-band spreading means which have low friction surfaces thereby minimizing any local stress on the expanding package material.

7 Claims, 10 Drawing Figures

PACKAGING IN EXTENSIBLE BANDS

RELATED INVENTION

This is a continuation-in-part of co-pending application Ser. No. 88,609 filed on Oct. 26, 1979 by Bernard R. Danti now U.S. Pat. No. 4,304,332.

BACKGROUND OF THE INVENTION

This invention relates to an improvement in the packaging of canned goods and the like. More particularly, the invention relates to packaging of the type wherein the goods are wrapped under the tension in, usually, two sheets of plastic, the sheets usually being wrapped about the package at right angles to one another.

In a co-pending application Ser. No. 88,609 filed on Oct. 20, 1979 by Bernard R. Danti, such a package is described as being conveniently made of sheets of flexible films with secant modules of 1500 to 5000 psi. These films are extended, typically, 30% to 50% during a snug wrap procedure thereupon, then the film is then heat-sealed and allowed to contract into a snug fit over the package. Unfortunately, extension to this degree during the wrapping procedure causes enough wrinkling of the film to either interfere with the efficacy of the heatseal procedure or to slow down the procedure to the point that commercial use of the process is limited.

These films are extended during a snug-wrap procedure. Thereupon, the resultant tension in the film is mechanically isolated from the area where heat sealing is to occur, e.g., by mechanical clamping. Residual tension is reduced to essentially zero in that the seal area by a number of means, e.g. changing web path length, for example, before the heat jaws are brought into contact with the film. All of the above must be accomplished in very little space so as to preserve the film extension introduced into the film initially.

Moreover, particularly packages as described in co-pending application Ser. No. 88,609 have 30–50% extension of the film bands in final form. Unfortunatley, these high stretch percentages cause high lateral contraction which results in severe wrinkling of the films so as to interfere with the heat sealing procedure described above in such fashion as to produce unacceptable packages, and machinery which is extremely complex, comprehensive, and slow in performance to the point that commercial use of the process is limited.

The package itself has so many benefits that it was desirable to seek an alternative packaging process.

SUMMARY OF THE INVENTION

It is a principle object of the invention to provide a novel process for making a package comprising at least one expansible wrap-around sheet member and of the type wherein the packaged goods are snugly held by the sheet member, Another object of the invention is to provide a novel process wherein excessive local stressing of the expansible sheet is avoided during the package-making procedure.

Another object is to provide a novel packaging apparatus.

A further object of the invention is to provide a novel web product particularly useful in the processes of the invention.

Other objects of the invention will be obvious to those skilled the art on their reading of this disclosure.

The above objects have been substantially achieved by a process wherein pre-formed packaging wraps, generally in the shape of tubular sections (called tubes, hoops or bands) of film open at each end of the tubular body, are extended to the required degree of extension, say 20% or more, by low-friction hoop-stretching means, conveniently by four fingers, or equivalent mechanical means, which provide means to pull the film apart far enough to allow insertion of the articles to be packaged. The fingers themselves, it has been found, advantageously comprise surface means which move relative to the film they contact. This ability to move, it has been found, markedly reduces local stresses on the film and reduces film defects caused by such stresses. This is particularly important because, in the packages under discussion, it is a film wrap that will usually be used to bear the weight of the entire package. A typical package would comprise about 12 or 24 cans of a beverage such as a soft drink. Such packages commonly weigh about 22 lbs. so, the avoidance of defects in the wrapping procedure is important when the film is to be used as a handle. The tubes of extensible film can be formed in a number of ways. Heatsealing is preferable, in most situations, to adhesive or mechanical procedures. For example, they can be formed by a procedure whereby:

STEP 1. A wide film is extruded and brought into register with another such film. These two films may be, but need not be, heatsealed together along their lateral edges to facilitated their handling as a web formed of two sheets of film, i.e. as a dual sheet. (If this edge seal is used, it is usually cut off, slit open, or otherwise discarded before Step 4.)

STEP 2. As the dual sheet moves along a processing line, heatseals are made across the advancing sheet appropriately-spaced intervals at, e.g., 16 inches. The heat seal area is preferably of substantial width, say about 0.4 inches wide, but it may be a single seal, or consist of two separate seals divided by a thin non-sealed area which may be perforated or otherwise weakened to allow a separation bearing an effective heat seal at either side of the separation.

STEP 3. The resulting web is slit along parallel lines running in the machine direction, also at appropriately spaced intervals at e.g., 14 inches. In practice, the interval can be readily changed to meet specifications.

STEP 4. The web is spooled—perhaps for shipment to the brewery at which the ultimate packages are made. Printing is optional before the packaging.

STEP 5. At the brewery, each 14 inch roll is unwound as needed to supply a packaging apparatus along which cans to be packaged move to the packaging station. As the roll is unwound, it is a separated precisely in the area of the heatseal so that a tube is formed which has a heat sealed area on opposite sides of the tube structure. The band is expanded to receive a package and the expanding means is removed, preferably after removing the expanding means to a center line of said package, to allow the film hoop to tighten about the package.

STEP 6. Then, a second band, usually, formed of a process paralleling steps 1–5, but of a different size when appropriate, is placed around the package at a 90 degree orientation to the first band as it leaves Step 5.

One embodiment of the aforesaid process is that wherein the initial heatseal, that normal to the machine direction of the processing line in Step Two, is carried out so that the bands or tubes applied in steps 5 and 6 are arranged alternately in the same row so they each may be applied from the same film feed station.

It is also to be noted that sheet material of FIG. 1 could be a flattened tube configuration as well as a dual web formed of independent sheets. In such a situation, the heatsealed perimeters serve as permanent bands and, on severing them from the loop, they may be fed to the packaging operation and spread open for use therein.

Another advantage of the process is inherent in the capabilities of the process to provide means to provide a more decorative package or a more economical package, i.e., one wherein the extensibility of the package is entirely due to the extensibility of one portion of the hoop only. Thus, if the two sheets of Step 1 are so selected that one is relatively inexpensive, and relatively less extensible sheet—e.g. formed of polyolefin, such as polyethylene and polyproylene or polyvinylchloride; sheet—then the other sheet can be formed of the more extensible and more expensive polymer sheet. Paper or foil may also be used as a less extensible sheet as may be laminations formed of any of paper, polymer film, or foil.

A particular problem is encountered in placing the packaged goods within the sheets when implementing the process of the invention. It is the problem of avoiding excessively localized stressing of the film as it is stretched to receive the package. A number of solutions to the problem are excessively expensive. However, a relatively inexpensive solution to the problem is a particular advantageous feature of the present invention. In this solution, the extensible-band package element is stretched into a means for receiving the goods to be packaged by mechanical means inserted inside the hoop element and moved to provide the required extension of the hoop. Local stresses are avoided, even at extension rates which are adequate for high-speed packaging lines, by the use of movable, low friction surface elements on the extension means which assure little or no relative motion between static surface elements and the sheet. These can be rotatable surfaces that will avoid friction induced by either relative movement of film and surface or tug of film against surface. Air bearing surfaces are also suitable.

As explained in copending application Ser. No. 88,609, it is desirable that the package be formed of tensioned plastic sheets which generally envelop each of two sets of four contiguous sides and generally form a perimeter about the package. A number of organic polymer films are suitable for such a purpose. These films should be extensible and while tension may be applied by heat shrinking, it is a particular advantage of the package that it does not require an energy-consuming heat-shrinking process. Among suitable films are those formed of such heatsealable thermoplastic polymers as medium density polyethylene, copolymers of polyethylene and vinyl acetate—preferably copolymers containing about 80% or more ethylene units—and polyvinylchloride.

Flexible films with secant moduli in the range of 1500 to 5000 psi are among those suitable. Such polymers may have ultimate tensile strengths of from 800 to 2000 psi and are characterized by good elongation characteristics. Typically useful polymers will be extended by 20 to 50% during the snug wrapping of a package assembly and then by about 5 to 15% when the package is lifted. Clearly, the convenient implementation of the handle-formation aspect of the preferred package depends upon the mass being lifted being of sufficient mass to extend the polymer somewhat but insufficient to cause elongation of the polymer to the break point. Suitable films may be purchased from Bemis Co., Inc., St. Regis Union Camp, and many other polymer film suppliers. Ethylene-vinyl acetate copolymer films with, say, a nominal 5–15 vinyl acetate content are particularly useful in making transparent packages.

The film, by which the package is to be grasped is the more critical film with respect to strength. The other film will primarily be used as a retaining member. A paper could serve as a retainer film at the cost of some of the advantages of the package. Moreover, a relatively light gauge film—say a 0.8 mil film—could be used as the retaining film in packages in which, say, 1.2 mil. films are used as the handle-forming film.

Another useful variation of the package is that wherein a narrower film is wrapped about the assembly before the wider film. (This will yield a package as shown in FIG. 1 modified only in that the narrower film is under, rather than on top, of the thick film. The advantage of this arrangement is that it makes the package difficult to pick up from the top but easier to pick up by the side. Therefore, when the consumer picks the package up using the narrow film strap exposed at the side, he will avoid the possibility of a package breaking because of abrasion of the bottom film which could have taken place during any relative motion on processing equipment in packaging operations.

It is preferred that the hoop or band forming the handle portion be so chosen, with respect to the mass of the package, that an angle A, as seen in FIG. 2 of at least 30 degrees be formed between the horizontal package and the upwardly extending handle portion of the web.

ILLUSTRATIVE EXAMPLE OF THE INVENTION

In this application and accompanying drawings there is shown and described a preferred embodiment of the invention and suggested various alternatives and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it and embody it in a variety of forms, each as may be best suited in the condition of a particular case.

Figure 1:
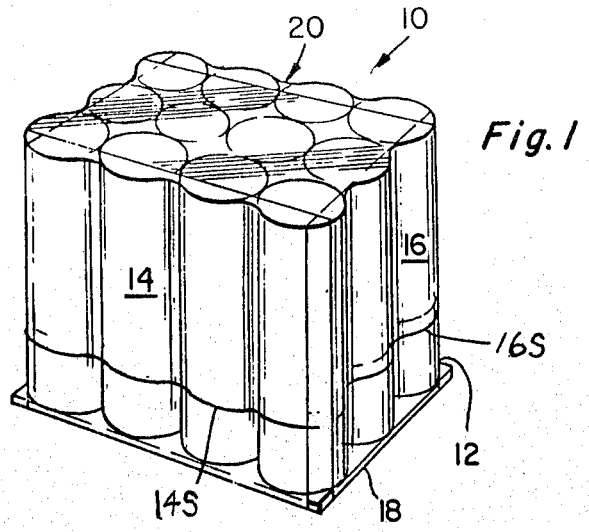
FIGS. 1 and 2 are perspective views of a package formed according to the process of the invention.

Referring to FIG. 1, there is seen a package 10 formed of two congruently and vertically-stacked groups of cans 12. The total number of cans is 24, the quantity equal to a case of, say, beer. Over package 10 is wrapped, under tension a transparent, sheet 14 of 2-mil thick ethylene-vinyl acetate (EVA) polymer film. Wrapped over sheet 14 is a similar sheet 16. Sheet 16 is similar to sheet 14 except that it is somewhat narrower. It is also wrapped under tension. A tray 18 is placed beneath the cans during the packaging operation. It serves to facilitate the handling characteristics of the package on automatic palletizing equipment and also to minimize excessive localized stresses on the package when it is used.

Figure 2:
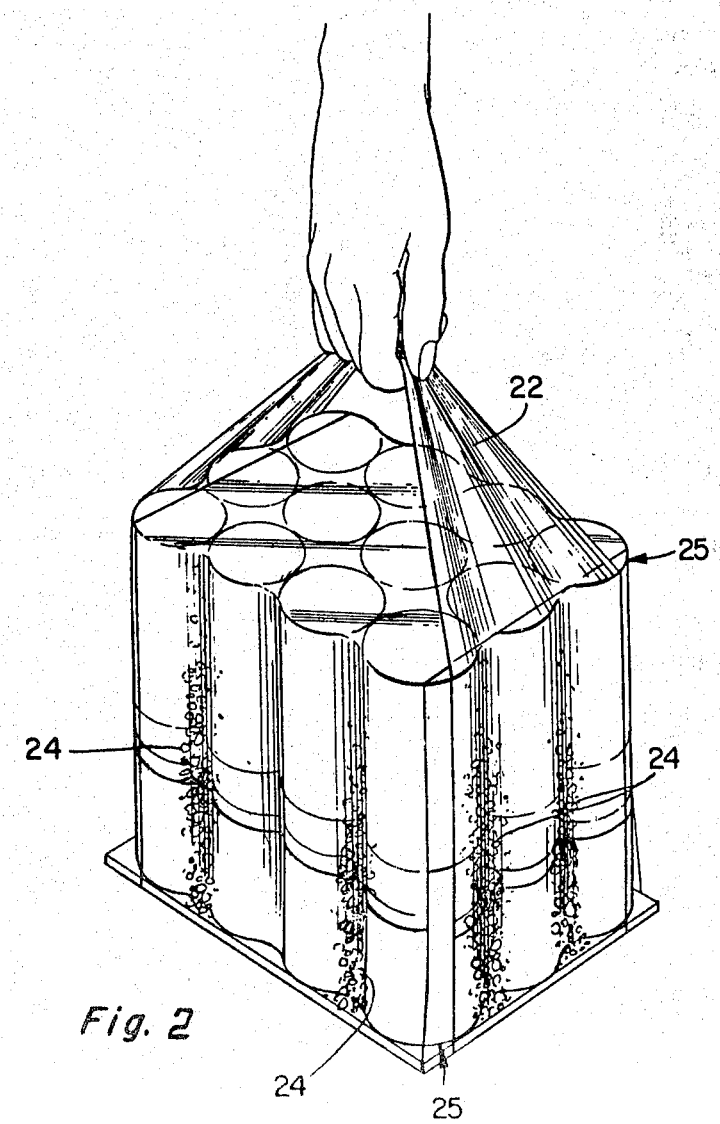

It will be noticed that cans 12 allow the tension-wrapped film to nip in slightly at 20, i.e. at the upper midpoint of the package. This feature facilitates the picking up of the package by a handle means 22 formed of the narrow exterior film as seen in FIG. 2. The extensibility of the film, together with the force exerted by weight of the bag, results in a strong secure package which is extremely convenient to carry. FIG. 2 also demonstrates another feature of the package. It is easy to push ice 24 through the corner openings 25 into the package and this is of value in pre-cooling the package.

Figure 3:
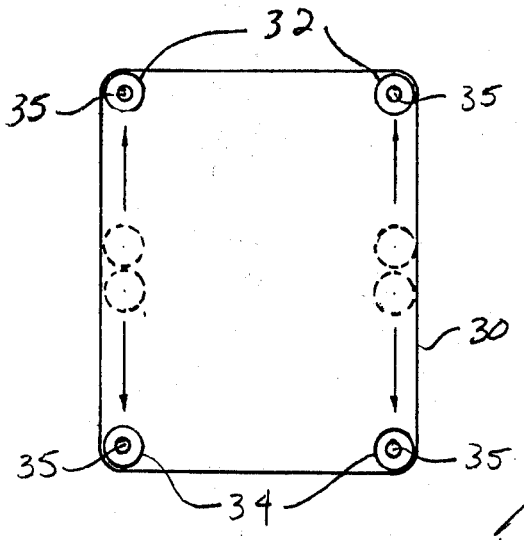
FIGS. 3–5 are schematic diagrams indicating the operation of one apparatus and process used to make the package of the invention.
Figure 4:
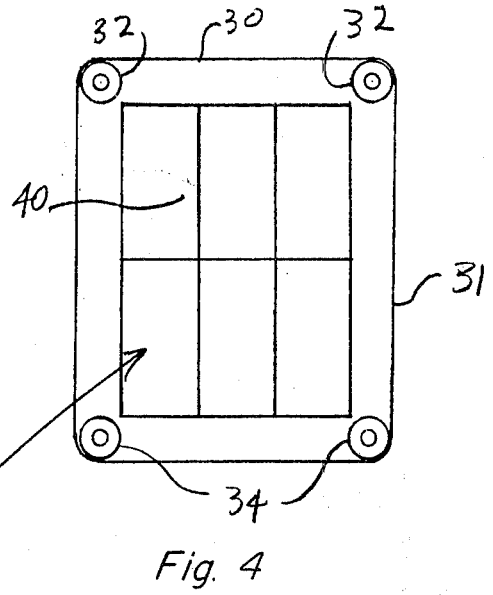
Figure 5:
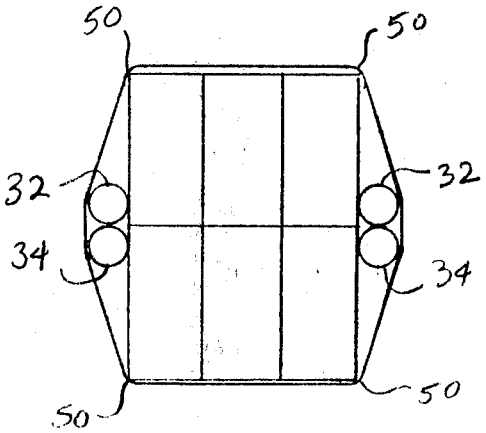

Although the process of the invention may be carried out in a number of ways, one advantageous procedure is shown in FIGS. 3–5. FIG. 3 illustrates, schematically, a hoop film 30 extended by the movement of an upper pair of rods 32 and a lower pair of rods 34. These rods, each rotatably mounted on shafts 35, extend the film and, as seen in FIG. 4, allow an assembly 36 of cans, the article to be packaged, to be inserted into the extended hoop 31. Then the pairs of rods 32 and 34 are brought together, as shown in FIG. 5, at a position remote from the stress-bearing corners of the package.

As they come together, film 30 contracts to contact package 40 at points 50. Points 50 then bear most of the stress on the package caused by the retracting film. The rods can then be withdrawn with relative ease from their remote position between the film and the article, in this case an assembly 36 of cans, to be packaged.

The precise manipulative or mechanical means used to insert the spread means formed of rotatably-surfaced bars is no part of the present invention. A number of readily-available techniques are known to those skilled in the art.

Figure 6:
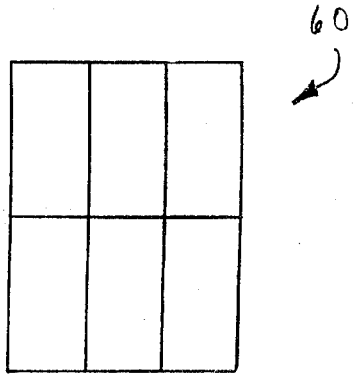
FIG. 6 shows a package, partially prepared, after the operation shown in FIGS. 3–5.

FIG. 6 illustrates the package 60 after one polymer band has been positioned. In practice, a second band is so positioned and is arranged along a set of four sides at right angles to the first band.

Figure 7:
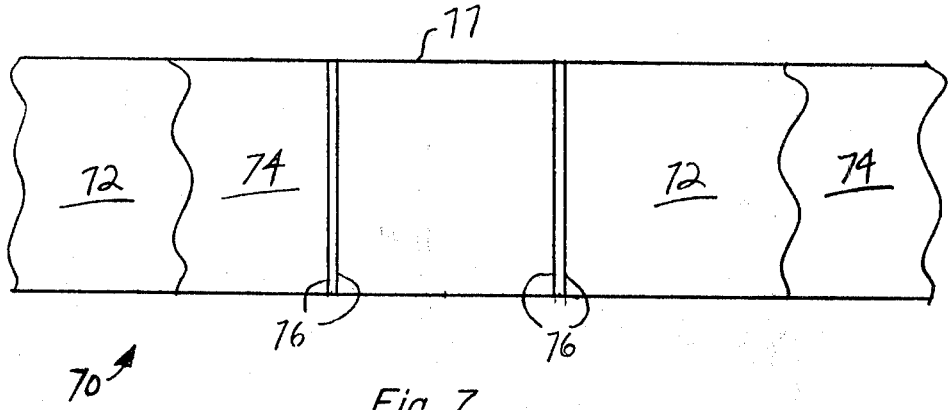
FIG. 7 is a plan view schematic and fragmentary of a dual web that is formed of an extensible plastic web usefully converted into packaging hoops and handles for use in the present invention.

FIG. 7 is a plan view showing, schematically illustrate novel polymer web 70 particularly useful in the process of the invention. Web 70 comprises polymeric sheets 72 and 74, with spaced heat seals 76. The webs are formed of stretched ethylene-vinylactate copolymer and may be extended 30%, in its linear dimension or more. It will be clear that dual web 70 can be a web slit along perimeters 77 from a much wider web.

Figure 8:
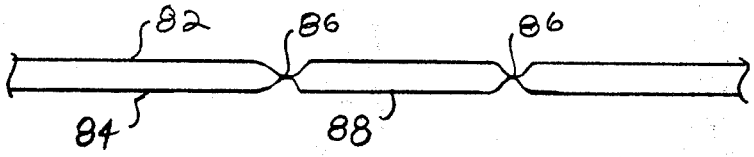
FIG. 8 is an elevation view of the web of claim 7.

A section in elevation of FIG. 8 shows, schematically, a similar web 80. Web 80 comprises a web 82 of the aforesaid stretch polymer. Sealed to it is a thin sheet 84, about 0.8 mil thick of medium density polyethylene. Most required extension takes place by extending sheet 82 by about 35%. Also seal 86, on being slit, comprises two independent heat seals with a mechanically weakened, non-heat-sealed section between them. When the heat seal is separated, a hoop 88 is formed, which hoop can be expanded for use according to the invention.

Figure 9:
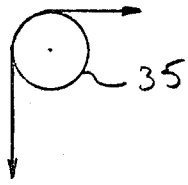
FIGS. 9 and 10 are illustrative of the kind of comparative directional force vectors which are exerted by the film in FIGS. 4 and 5, respectively.
Figure 10:
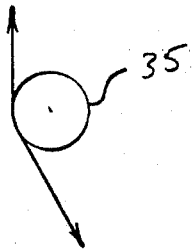

FIGS. 9 and 10 are illustrative of the kind of comparative directional force vectors exerted by the film on the spreader elements in FIGS. 4 and 5 whereby the direction of tension forces on the film is directed in such a way in FIG. 4 to put a great deal of stress on the spreader elements. In FIG. 5, on the other hand, the amount of force, geometrically analyzed, is much less. It is pointed out that the force is substantially lessened quantitatively, also, because of the lesser extension in the FIG. 5 position. This principle is useful with any low-friction surface, whether it be an air-bearing, the rotable-sleeve device illustrated or merely a highly lubricated surface.

It is also to be understood that the following claims are intended to coverall all of the generic and specific features of the invention herein described and all statements of the scope of the invention whigh might be said to fall therebetween.

What is claimed is:

1. A process for packaging articles snugly within extensible hoops formed of stretchable polymeric film, said process comprising the steps of:

(a) inserting a plurality of mechanical spreader means within a said hoop while it is in a non-extended position;

(b) contacting extensible portions of said hoop only with surfaces of each of said spreader means which are freely rotatable about an axis parallel to the direction of insertion;

(c) moving said plurality of rotatable spreader means away from each other in a direction perpendicular to the direction of insertion to an extended position thereby causing each of said spreader means to freely rotate in response to the stress exerted by said film on said spreader means surfaces to thereby uniformly stretch said hoop;

(d) placing an article within said hoop;

(e) moving said spreader means from said extended position to allow said stretched hoop to relax into snug contact with portions of the surface of said article to be packaged; then, (f) removing said spreading means from within said hoop.

2. A process as defined in claim 1 wherein said removal of spreader means is preceded by moving each said spreader means along said article being packaged to a point removed from said extended position, bringing portions of said relaxing film into stress-bearing contact with said article; and withdrawing said spreader means to a position which is removed from said portions of said article in said stress-bearing contact with said film closer to a center line of said package.

3. A process as defined in claims 1 or 2 wherein said spreader means comprise four rods, the surfaces of which are rotatable and wherein such rods are in pairs the member of each pair forming means to move apart and stretch said film.

4. A process as defined in claim 1 for snugly packaging articles within extensible hoops of polymer film, said process further comprising the steps of:

(a) sealing two webs, at least one web of which is formed of an extensible polymer film, at a first preselected spacing transverse said webs to form a series of closed bands;

(b) connecting one web to the other by said seal areas;

(c) forming individual hoops by separating the closed bands along a line within said seal areas.

5. A process as defined in claim 4 wherein one web is a relatively less extensible material formed of polymer film, a metal foil, paper, or a laminated formed at least two of polymer film, a metal foil, and wherein the other film is an extensible plastic capable of being stretched at least 30% during said applying means to force said hoop to receive an article.

6. A process as defined in claim 4 wherein said sealing is heatsealing.

7. A process for packaging articles snugly within extensible hoops formed of stretchable polymeric films said process comprising the steps of:

(a) inserting a plurality of mechanical spreading means within a said hoop while it is in a non-extended position, each of said spreading means being freely rotatable about an axis parallel to the direction of insertion, (b) uniformly stretching said hoop into an extended hoop by movement of said plurality of spreader means away from each other in a direction perpendicular to the direction of insertion to first positions, and while stretching, causing the surface of each of said spreader means to rotate in response to stresses exerted thereon by said hoop as it is stretched, (c) placing said article to be packaged within said extended hoop; then (d) moving said spreader means, from said first positions, along said article to second positions in which said spreader means are remote from said extended position, allowing said film to contract and bear against said article at positions remote from said second positions, then withdrawing said spreader means from between said film and said article to be packaged.

* * * * *